US010406070B2

(12) United States Patent
Morelle et al.

(10) Patent No.: US 10,406,070 B2
(45) Date of Patent: Sep. 10, 2019

(54) PERFORATING NEEDLE FOR FLASK WITH SEPTUM

(71) Applicant: TRASIS SA, Ans (BE)

(72) Inventors: Jean-Luc Morelle, Liege (BE); Frederic Baplue, Fraiture (BE); Gauthier Philippart, Avins (BE)

(73) Assignee: TRASIS S.A., Ans (BE)

( * ) Notice: Subject to any disclaimer, the term of this patent is extended or adjusted under 35 U.S.C. 154(b) by 0 days.

(21) Appl. No.: 15/778,638

(22) PCT Filed: Nov. 25, 2016

(86) PCT No.: PCT/EP2016/078876

§ 371 (c)(1),
(2) Date: May 24, 2018

(87) PCT Pub. No.: WO2017/093141

PCT Pub. Date: Jun. 8, 2017

(65) Prior Publication Data

US 2019/0000715 A1 Jan. 3, 2019

(30) Foreign Application Priority Data

Dec. 3, 2015 (BE) ..... 2015/5782

(51) Int. Cl.
*A61J 1/20* (2006.01)
*A61J 1/14* (2006.01)

(52) U.S. Cl.
CPC ..... *A61J 1/201* (2015.05); *A61J 1/1406* (2013.01); *A61J 1/2027* (2015.05); *A61J 1/2031* (2015.05);
(Continued)

(58) Field of Classification Search
CPC ..... A61J 1/201; A61J 1/1406; A61J 1/2027; A61J 1/2051; A61J 1/2055; A61J 1/2065;
(Continued)

(56) References Cited

U.S. PATENT DOCUMENTS 2,746,455 A * 5/1956 Abel ..... A61M 5/162 604/411
2,989,053 A * 6/1961 Hamilton ..... A61M 5/162 604/274

(Continued)

FOREIGN PATENT DOCUMENTS

EP 0614653 A2 9/1994
GB 829383 A 3/1960

(Continued)

*Primary Examiner* — Andrew M Gilbert
(74) *Attorney, Agent, or Firm* — Leydig, Voit & Mayer, Ltd.

(57) ABSTRACT

A perforating needle intended to be inserted into a flask through a stopper or septum to inject and remove a fluid includes a pointed end for piercing the stopper and a cylindrical body. The central body includes a central channel through which the fluid may enter and leave the flask and a side wall having at least one lateral orifice. The orifice is in fluid communication with the central channel. A lower end of the orifice is, in use, essentially level with an inner face of the stopper. The orifice is extended toward the pointed end by at least one slot, a shape of which is essentially tangential to a flow of the fluid so as to channel the fluid along an axis of the needle. The side wall includes at least two diametrically opposite lateral orifices arranged on either side of a central island.

9 Claims, 9 Drawing Sheets

(52) U.S. Cl.
CPC ..... *A61J 1/2051* (2015.05); *A61J 1/2055* (2015.05); *A61J 1/2065* (2015.05); *A61J 1/2096* (2013.01)

(58) Field of Classification Search
CPC .... A61J 1/2096; A61M 5/148; A61M 5/3286; A61M 5/329; A61M 5/3291
See application file for complete search history.

(56) References Cited

U.S. PATENT DOCUMENTS 4,411,661 A * 10/1983 Kersten ..... A61M 5/162 222/567
5,526,853 A * 6/1996 McPhee ..... A61J 1/2089 141/114
6,258,078 B1 * 7/2001 Thilly ..... A61J 1/2096 604/411
6,261,267 B1 7/2001 Chen
8,512,309 B2 * 8/2013 Shemesh ..... A61J 1/2096 604/414
2002/0104584 A1 * 8/2002 Spero ..... A61J 1/2089 141/329
2002/0127150 A1 * 9/2002 Sasso ..... A61J 1/2096 422/569
2004/0039365 A1 * 2/2004 Aramata ..... A61J 1/2096 604/411
2004/0199139 A1 * 10/2004 Fowles ..... A61J 1/1406 604/414
2006/0200095 A1 * 9/2006 Steube ..... A61J 1/2096 604/272

FOREIGN PATENT DOCUMENTS

WO WO 2009029010 A1 3/2009
WO WO 2009030788 A1 3/2009

* cited by examiner

PERFORATING NEEDLE FOR FLASK WITH SEPTUM

CROSS-REFERENCE TO PRIOR APPLICATIONS

This application is a U.S. National Phase application under 35 U.S.C. § 371 of International Application No. PCT/EP2016/078876, filed on Nov. 25, 2016, and claims benefit to Belgian Patent Application No. BE2015/5782, filed on Dec. 3, 2015. The International Application was published in French on Jun. 8, 2017 as WO 2017/093141 under PCT Article 21(2).

FIELD

The present invention relates to a device for transferring fluids between a container for example containing a medicinal drug or any other ingredient (in solid or liquid form) for the preparation thereof and an injection means. The invention more particularly relates to a perforating needle.

BACKGROUND

In the field of pharmaceutical preparations, ingredients are commonly provided in containers. The product contained in a vial is transferred using a syringe or by pressure difference toward the preparation device, for example a syringe or toward a specific preparation or synthesis device, in order to constitute the medicinal drug or one of its precursors.

In some cases, the product is provided in liquid form in a vial while in other cases, it assumes the form of a solid, for example powdered or freeze-dried. In the case of a powder, it is most often deposited or evaporated on the bottom of the flask. To recover this powder, a solvent must be introduced into the vial to dissolve the powder. The reconstituted product is then extracted from the vial and transferred to the location of use.

These products are frequently withdrawn from an inverted vial, i.e. with the opening pointing down, having a septum (or elastomeric stopper) or another access means capable of being pierced at the base of the vial. The connection of the vial is achieved by piercing the stopper of the vial using a perforating needle. The vial is therefore "upside down" with the needle perforating the stopper.

A hollow perforating needle as known from the prior art provides a fluid communication means with the contents of the vial. In particular, the tip can pierce the septum, allowing to insert a solution or to empty the content of the vial.

A conventional needle is made up of a sharp tip and a hollow access tube allowing a fluid to flow for example from a perfusion pouch as described in patent U.S. Pat. No. 6,261,267 B1. The solution continues to flow until the meniscus of the fluid in the vial drops below the end of the tip, leaving a certain quantity of residual liquid in the vial.

The products contained in containers in a small quantity are metered with a precision required by the preparation method or the clinical indication. This precision may be significant. Consequently, not recovering all of the product contained in the vial may cause variations in the quality of the preparation or the quantity transferred.

A conventional perforating needle, as shown in FIG. 1, comprises a central channel 11 ending with an orifice that is in the extension of the channel. The perforating needle 1 of FIG. 1 is shown in a flask 2 after it has pierced the septum 6. This needle 1 comprises a cylindrical body 3, a stop 4, and a pointed end 5. The cylindrical body 3 extends from a distal end 9 of the needle toward a proximal end 10. At its distal end 9, the cylindrical body 3 comprises a side wall 12 surrounding a central channel 11 ending with an orifice at the pointed end 5.

Such a needle allows to send a vertical jet of solvent that can reach the apex of the flask (or the bottom of the flask, given that the latter is inverted) and thus to recover in the solvent all of the reagent present, even if it is deposited in solid form on all of the inner walls of the flask. However, such a perforating needle does not allow to empty the flask entirely. A fraction of the fluid 7 always remains unrecoverable below the level of the orifice of the tip 5 (see FIG. 1D). Furthermore, the piercing point is off-centered, which causes an alignment defect of the flasks relative to the axis of the needle and is problematic in automated systems. Lastly, off-centered tips are generally not as sharp.

Document WO 2009/029010 A1 discloses another needle comprising at least one lateral opening allowing to completely empty a vial. Such a perforating needle is shown in FIG. 2. The perforating needle 1 comprises a non-through central channel 11 and two lateral openings 8 at its distal end 9. The opening is just above the septum 6, such that all of the fluid contained in the flask can flow through the lateral opening 8 in the central channel 11.

However, although such a needle allows to empty the flask entirely, the needle does not allow to produce a solvent jet that is vertical enough to reach the bottom of the flask and thus to recover all of the product deposited on the walls.

SUMMARY

In an embodiment, the present invention provides a perforating needle intended to be inserted into a flask through a stopper or septum to inject and remove a fluid, the needle comprising: a pointed end configured to pierce the stopper; and a cylindrical body comprising a central channel through which the fluid may enter and leave the flask and a side wall comprising at least one lateral orifice, the orifice being in fluid communication with the central channel and a lower end of the orifice being, in use, essentially level with an inner face of the stopper, the orifice being extended toward the pointed end by at least one slot, a shape of which is essentially tangential to a flow of the fluid so as to channel the fluid along an axis of the needle, wherein the side wall comprises at least two diametrically opposite lateral orifices arranged on either side of a central island, the central island having a separating rim forming an angle of between 15° and 60°, wherein the separating rim penetrates the central channel, and wherein the slots extending the orifices emerge near the pointed end.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
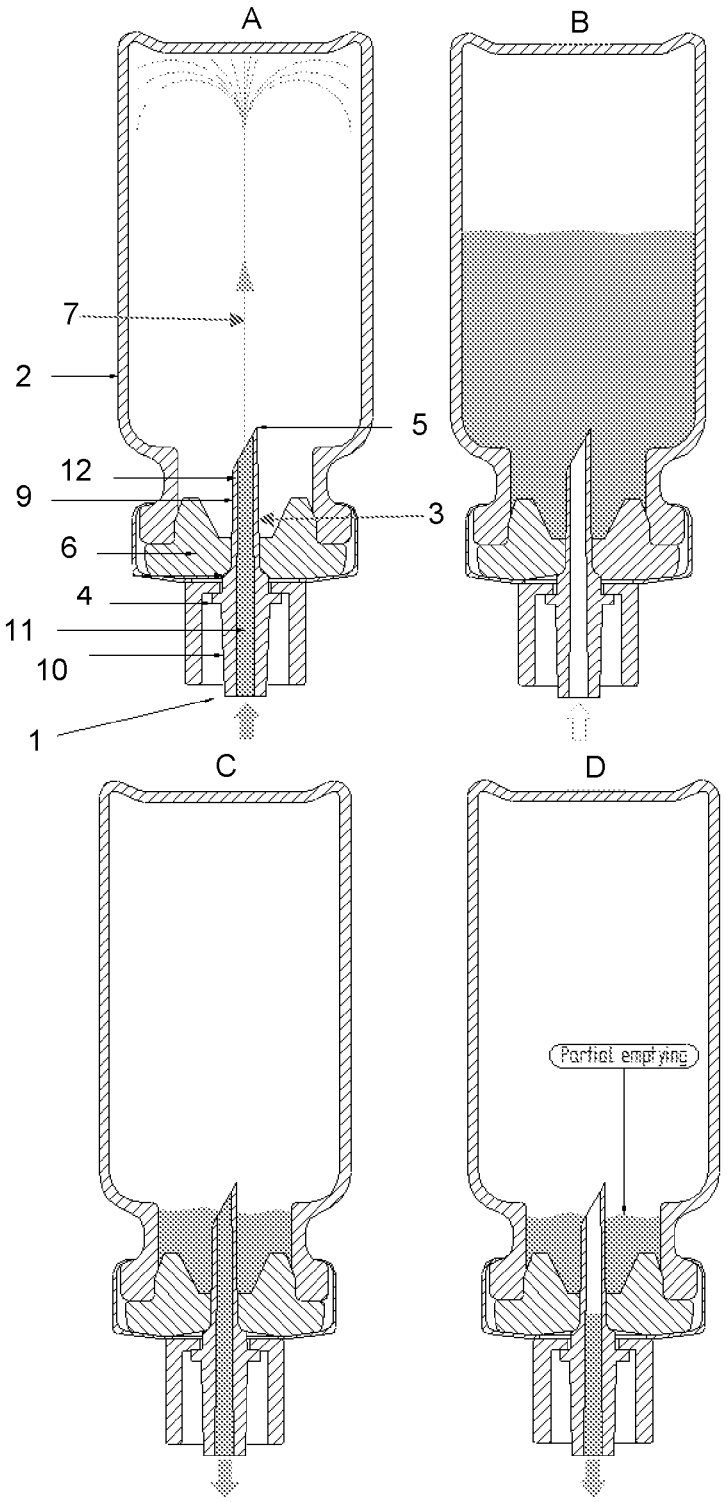
PRIOR ART FIG.1
FIG. 1, mentioned above, schematically shows the steps (A, B, C, D) of the operating principle of a prior-art perforating needle comprising an orifice in the axis of the central channel. Such a needle does not allow to empty the flask completely.
Figure 2:
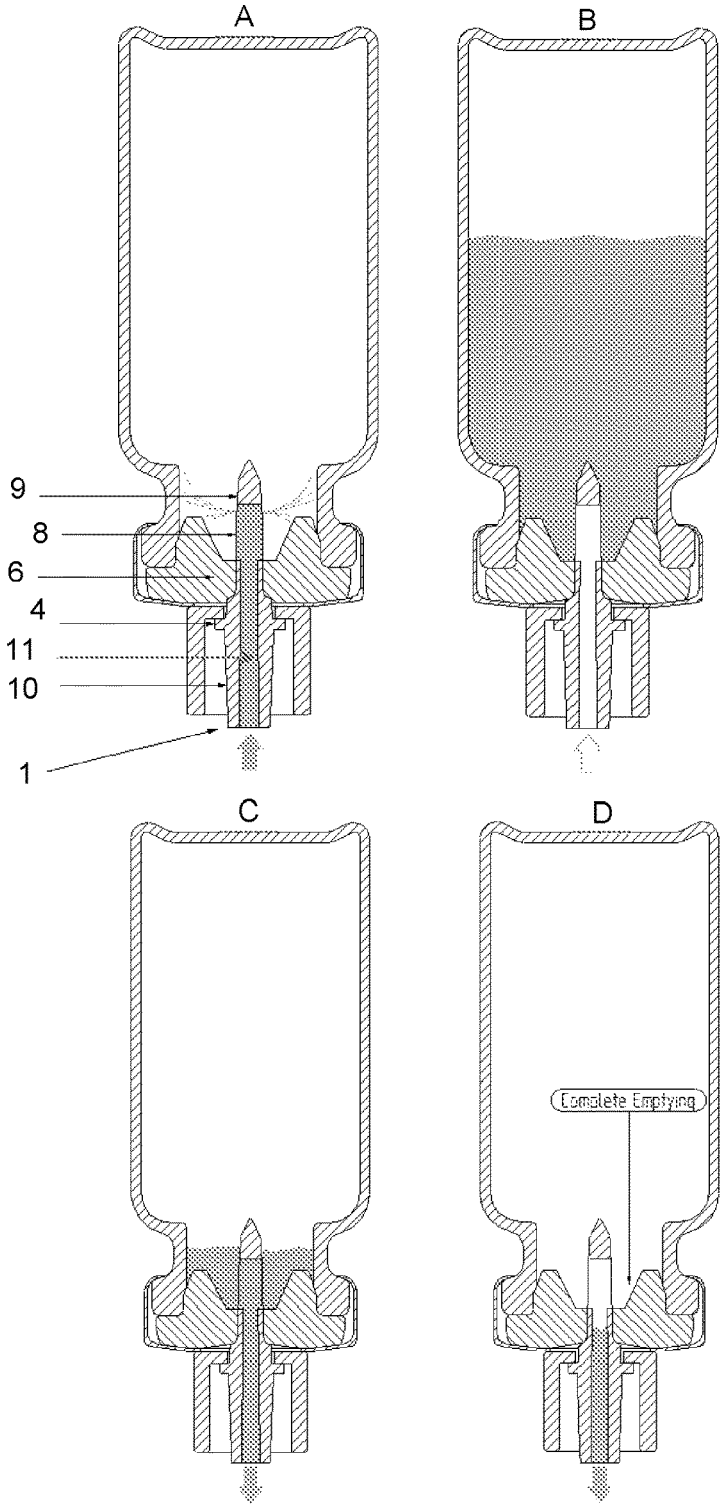
PRIOR ART FIG.2
FIG. 2, mentioned above, schematically shows the steps (A, B, C, D) of the operating principle of a prior-art perforating needle comprising one or several lateral orifices. Such a needle does not allow to produce a jet of solvent that is vertical enough to reach the bottom of the flask and thus to recover all of the product deposited on the walls.
Figure 3A:
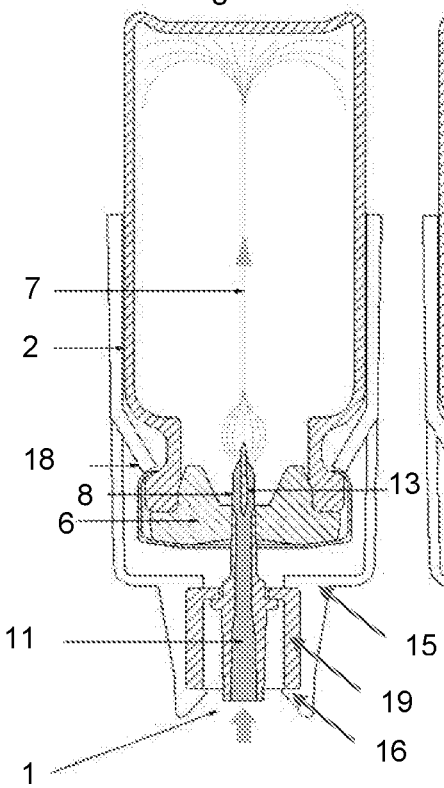
FIGS. 3A-3D schematically show the steps of the operating principle of the perforating needle according to the invention. After the septum is pierced, a solution is introduced in an essentially vertical jet into a vial, then the content of the vial is completely emptied. The needle is shown provided with a nut and capped by a guiding accessory of the vial.
Figure 3B:
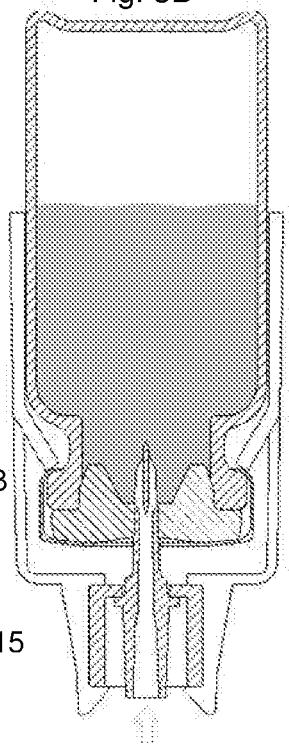
Figure 3C:
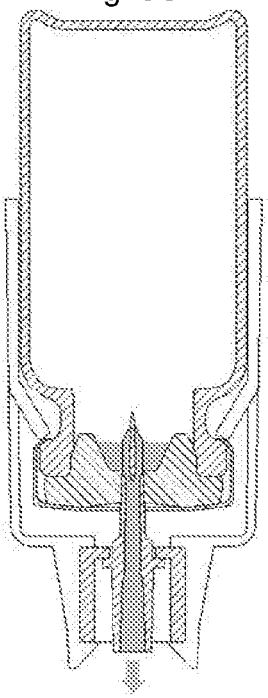
Figure 3D:
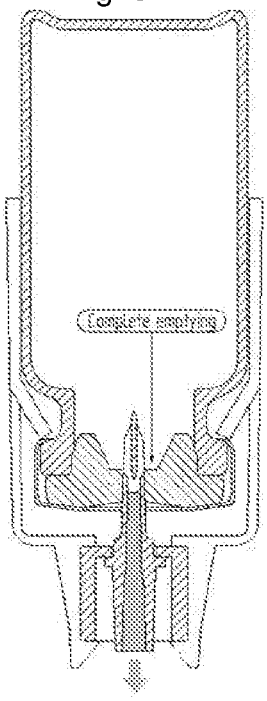

Embodiments of the device of the invention aims to allow both to achieve optimal injection of a liquid into a vial containing, beforehand, a product in solid form dispersed on the inner wall or in liquid form in order to completely recover it in the liquid, and to extract from the vial the solution or mixture thus formed while completely emptying the liquid in the vial, thus leaving no residue.

A first aspect of the present invention relates to a perforating needle, also called "spike", intended to be inserted into a flask through a stopper or septum to inject and extract a fluid, said needle comprising:

- a pointed end configured to pierce the stopper;
- a cylindrical body comprising a central channel through which the fluid can enter and exit the flask and a side wall comprising at least one lateral orifice, said orifice being in fluid communication with the central channel and the lower end of this orifice being, in use, essentially level with the inner face of the stopper, said orifice being extended toward the pointed end by a slot, the shape of which is determined to be essentially tangential to the flow of the fluid, for the purpose of channeling it along the axis of the needle, characterized in that the side wall comprises two diametrically opposite lateral orifices arranged on either side of a central island, the central island having a separating rim forming an angle comprised between 15° and 60°, preferably between 20° and 30°, in that the separating rim penetrates the central channel and in that the slots extending the orifices emerge near the pointed end.

The perforating needle is intended to be inserted into a flask to be pierced in order to inject and/or remove a fluid. When the reagent must be kept in solid form, it is generally deposited on the walls, and more particularly on the bottom of the flask using evaporation or freeze-drying techniques known by those skilled in the art.

In use, the solid reagent is recovered by introducing an appropriate solvent via the perforating needle, then by aspirating the solution in which the solid reagent has dissolved or has been entrained. This requires that the entire inner surface of the flask can possibly be wet.

Preferred embodiments of the invention further comprise, in combination, one or more of the following features:

- the perforating needle is made up of rigid plastic material;
- the perforating needle is intended to be inserted into a flask comprising an elastomeric or plastic stopper;
- the perforating needle comprises a wider zone of the side wall called stop on which a nut that is configured to firmly attach the needle on a fluid connection device can bear;
- the perforating needle is further accompanied by a guiding accessory configured to be irreversibly attached on the perforating needle, if applicable using a nut, to maintain and guide the flask;
- the guiding accessory comprises hooks allowing to keep the guiding accessory on the needle, directly or using a nut;
- the guiding accessory comprises pairs of fins that are configured to maintain the flask irreversibly. Preferably, a first pair of fins is placed in a high position to keep the flask above the needle before the stopper is pierced, while a second pair of fins is placed in a low position in order to keep the flask pushed in on the needle after the stopper has been pierced.

An embodiment of the present invention relates to a perforating needle designed to allow the creation of an essentially vertical jet of solvent in a flask from one or several lateral orifices that also allow to empty the flask completely. The four-step operating principle (A, B, C, D) is illustrated in FIG. 3. The perforating needle 1 is shown in a flask 2 after the septum 6 has been pierced. The lateral orifices are located just above the stopper, level with the inner face of the latter. First (step A), the needle 1 allows to inject a fluid 7 vertically into the flask in order to solubilize the content, for example in the form of a powder adhering to the walls of the flask, primarily in the bottom. The flask is next completely emptied of its contents (steps B, C and D), the solution flowing through the lateral orifices 8 of the needle in the central channel 11.

The performance in the essentially vertical injection of liquid is obtained owing to the particular shape of the flow surfaces of the liquid stream in the rising situation. The rising vertical stream may or may not be divided. When the stream is not divided, the central channel 11 opens onto a lateral orifice 8 extended toward the pointed end 5 by a slot 17 (shown in FIG. 4). The shape of the slot provides the flow of the fluid toward the tip and an essentially vertical jet is obtained along the axis of the perforating needle.

According to the embodiment shown in FIG. 3, the vertical stream is divided in two. The central channel 11 opens on two lateral orifices 8, each orifice being extended toward the pointed end 5 by a slot 17. The stream of fluid is channeled around a central island 13 making up a separating rim 14 (shown in FIG. 6C) for the rising stream of liquid. The fluid 7 follows the central island 13 with an essentially convex shape, the surrounding pressure not allowing the fluid to move away from the latter. As a result, the needle allows to spray the fluid along its essentially vertical axis and to recover it completely via one or several lateral orifices 8.

Figure 9:
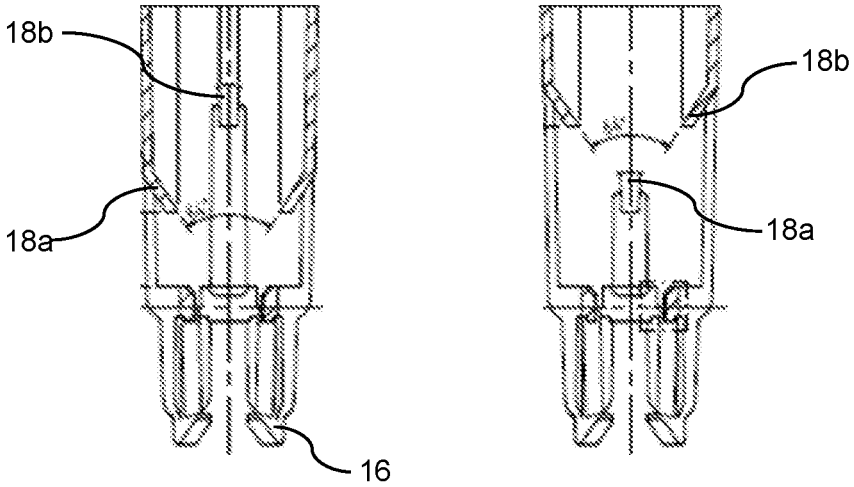
FIG. 9 shows two sectional views of the guiding accessory shown in FIG. 8. These sectional views show pairs of fins for maintaining the vial in high and low positions of the guiding accessory.

A guiding accessory 15 is also shown in FIG. 3. This accessory allows to facilitate the vertical insertion of the flask 2 on the perforating needle 1. A nut 19 bears on the stop 4 of the needle, allowing to attach the latter firmly on the connecting device. The guiding accessory is positioned on this nut (see FIG. 10). The guiding accessory 15 comprises hooks 16 wedged on the nut 19. This operation ensures good alignment of the guiding accessory relative to the needle. The guiding accessory 15 also comprises a pair of lower fins 18*a* in the low position allowing to keep the flask 2 pushed on the needle after the latter has pierced the septum. There is also a pair of upper fins 18*b* in a high position (shown in FIG. 9) and allowing to keep the flask in the guiding accessory before the septum is pierced.

Figure 4:
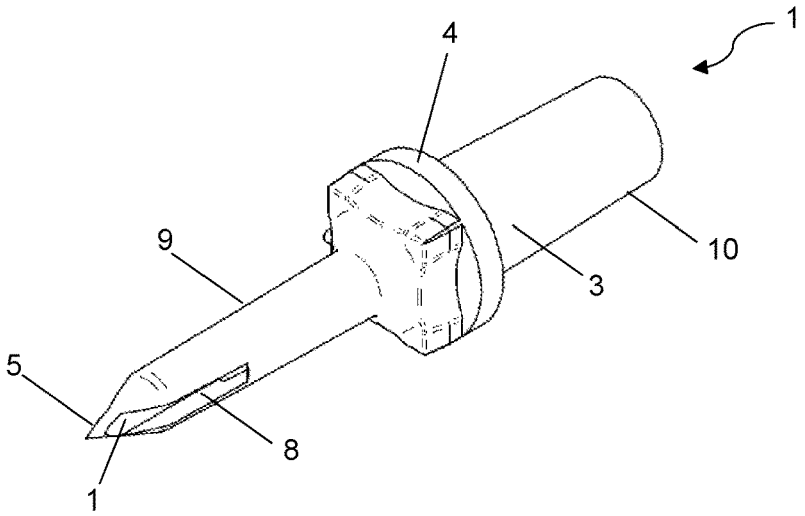
FIG. 4 shows a perspective view of an example perforating needle according to the invention.

FIG. 4 is a perspective illustration of the perforating needle according to the invention. This needle 1 comprises a cylindrical body 3, a stop 4, and a pointed end 5. The cylindrical body 3 extends from a distal end 9 of the needle toward a proximal end 10. At its distal end 9, the cylindrical body 3 comprises a central channel 11 that is subdivided into two lateral orifices 8 extending with two slots 17 emerging near the pointed end 5.

Figure 5A:
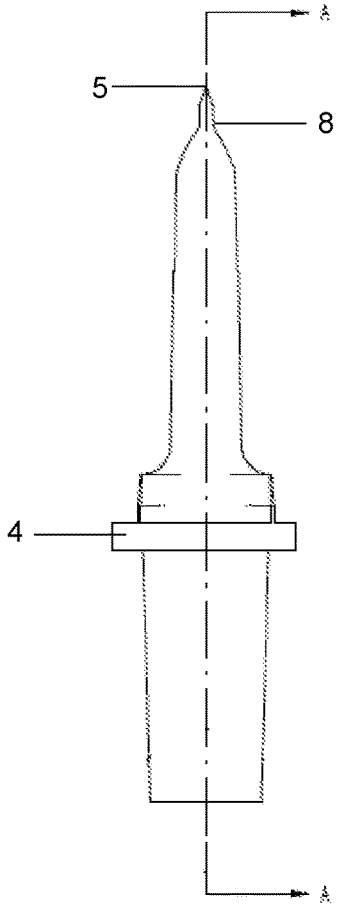
FIG. 5A shows a profile view of the needle shown in FIG. 4.

FIG. 5A shows a profile view of the needle shown in FIG. 4 in which the lateral orifices 8 are located on either side of the pointed end 5.

Figure 5B:
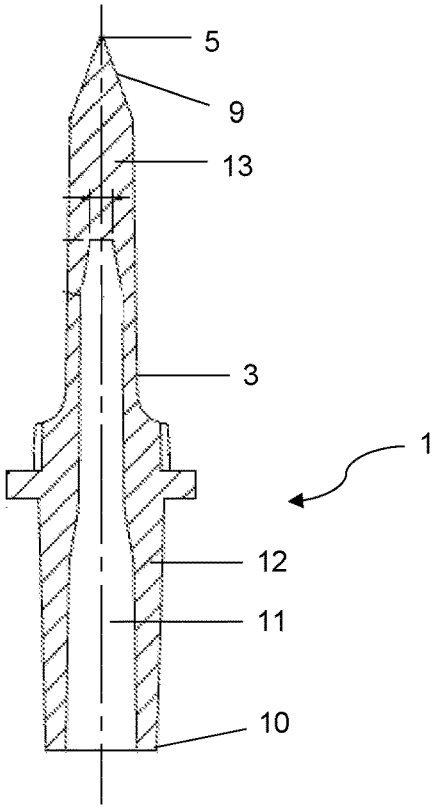
FIG. 5B shows a sectional view of the needle shown in FIG. 5A along section A-A.

FIG. 5B is a sectional view corresponding to FIG. 5A along section A-A. In this sectional view, the cylindrical body 3 comprises a central channel 11 surrounded by a side wall 12 that extends from the proximal end 10 of the needle, but stops before reaching the distal end 9. The central channel 11 is subdivided at this level into two lateral orifices 8 around a central island 13.

Figure 6A:
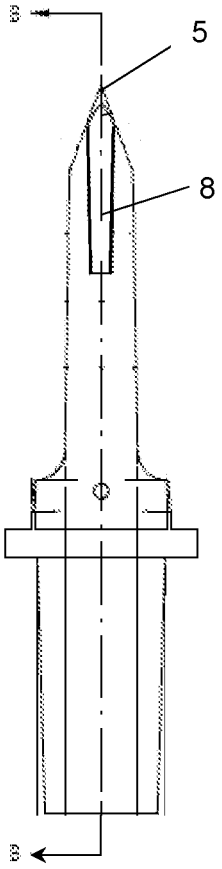
FIG. 6A shows a profile view of the needle of the invention pivoted by a 90° angle relative to the device shown in FIG. 5A.

FIG. 6A shows a profile view of the needle of the invention pivoted by a 90° angle relative to the device shown in FIG. 5A. A first lateral opening 8 is shown from the front and the other opening 8 is in the background, diametrically opposite the first.

Figure 6B:
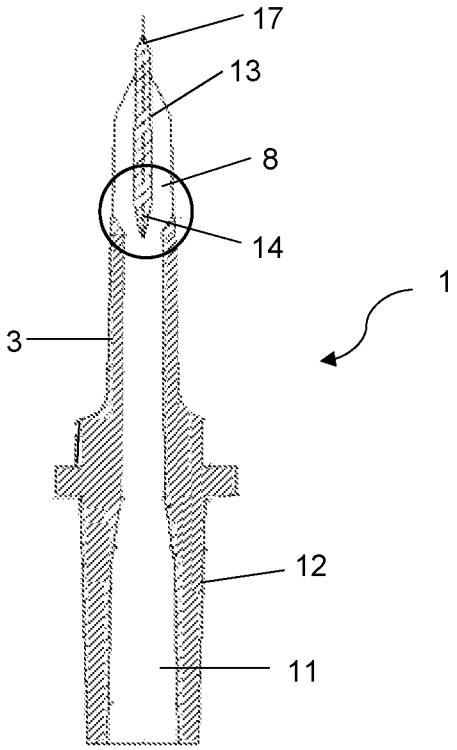
FIG. 6B shows a sectional view of the needle shown in FIG. 6A along section B-B.

FIG. 6B shows a sectional view corresponding to FIG. 6A along section B-B. In this sectional view, the cylindrical body 3 comprises a central channel 11 surrounded by a side wall 12 that extends from the proximal end 10 of the needle to its distal end 9. Near the distal end 9, the central channel 11 is divided into two lateral orifices 8 that are separated from each other by a central island 13. This island is positioned at the end of the central channel 11. It begins with a separating rim 14 that divides the incoming liquid stream in two, extends laterally by essentially straight forms and ends with the pointed end 5. The central island 13 constitutes an extension of the side wall 12 in this plane, as shown in FIG. 5B.

Figure 6C:
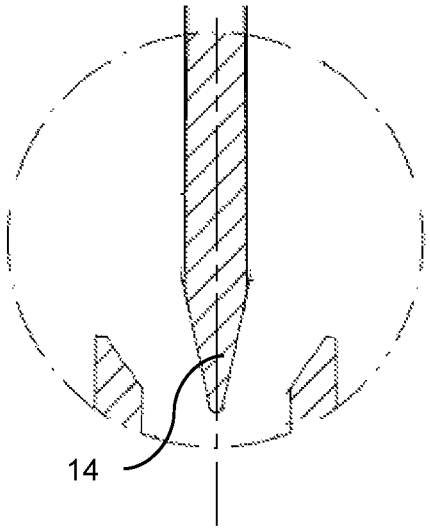
FIG. 6C shows a detailed view of the circled portion of FIG. 6B.

FIG. 6C shows a detailed view of the circled portion of FIG. 6B. Preferably, the angle formed by the separating rim 14 of the central island 13 is comprised between 15° and 60°. As an example, it is 24° in FIG. 6C.

Figure 7:
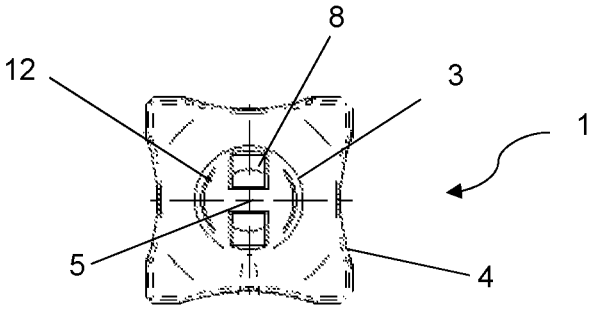
FIG. 7 shows an axial view of the perforating needle, the pointed end appearing in the foreground.

FIG. 7 shows an axial view of the perforating needle 1. From the first plane to the last plane can be successively seen: the pointed end 5, the lateral orifices 8, the side wall 12 of the cylindrical body 3 and the upper part of the stop 4.

In order to facilitate the well-centered vertical insertion of the perforating needle 1 in the septum of the cap of the flask 2, a guiding accessory 15 can be used. This accessory is configured to be fastened irreversibly on the perforating needle 1, directly or via a nut 19 (see FIG. 11).

Figure 8:
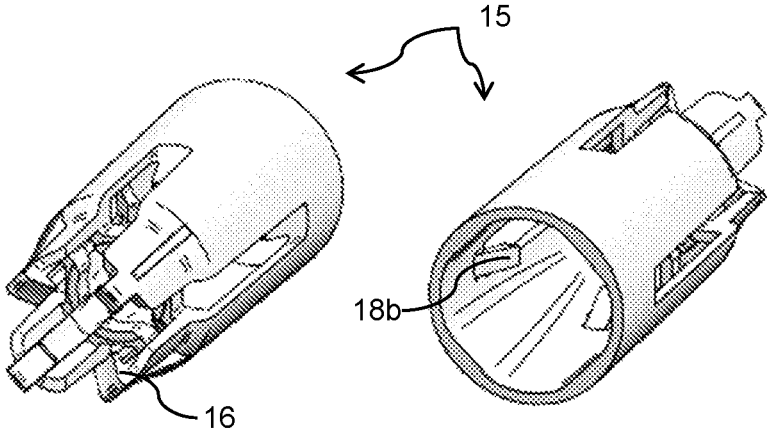
FIG. 8 shows two perspective views of an accessory for guiding the vial on the perforating needle of the invention.

An example guiding accessory is shown in FIG. 8. The left drawing shows the end of the accessory catching on the nut 19 of the needle and the right drawing shows the end of the accessory by which the flask 2 is inserted.

Figure 10A:
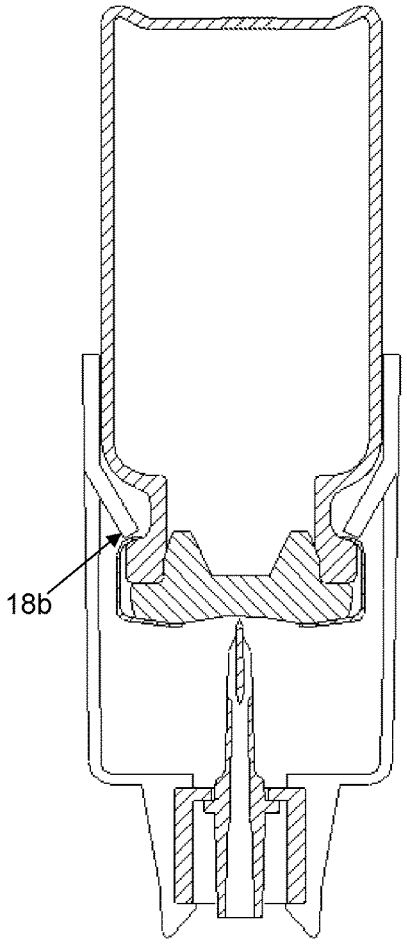
FIGS. 10A-10B show two sectional views of the perforating needle combined with the guiding accessory, that on the left with the vial in the high position before the septum (FIG. 10A) is pierced and that on the right with the vial in the low position after the septum (FIG. 10B) has been pierced.
Figure 10B:
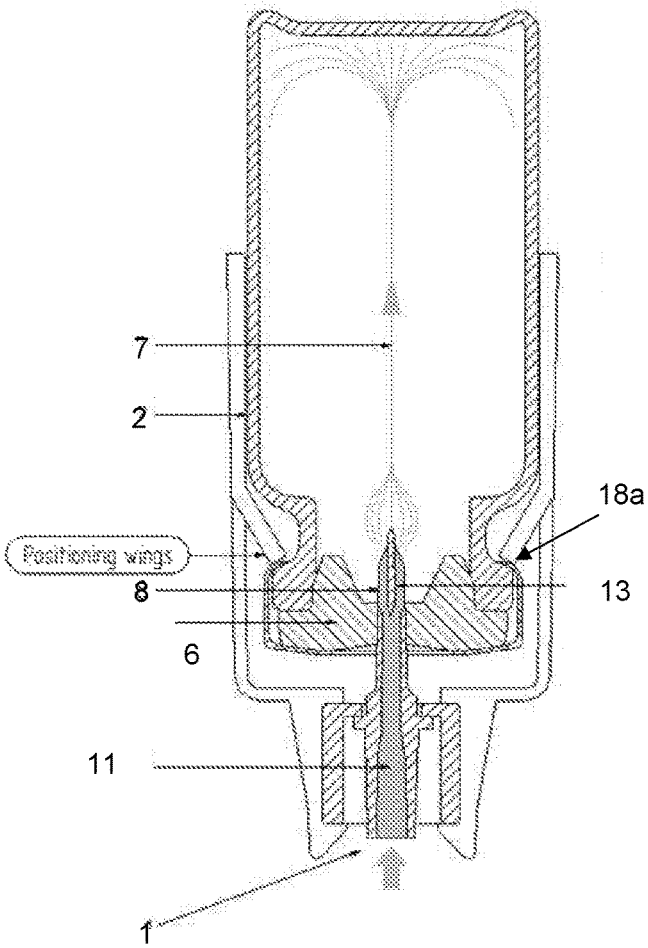
Figure 11A:
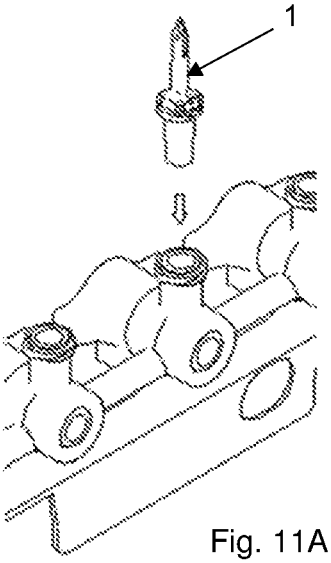
FIGS. 11A-11D show perspective views of the mounting of the perforating needle on a connecting device allowing to introduce a fluid therein (FIG. 11A), the positioning of a nut (FIG. 11B) against the stop of the needle, the positioning of the guiding accessory (FIG. 11C) on the needle provided with a nut and the completed mounting (FIG. 11D) ready to accommodate the flask in the inverted position.
Figure 11B:
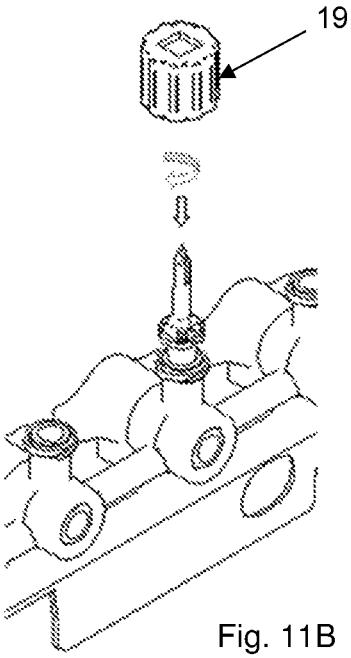
Figure 11C:
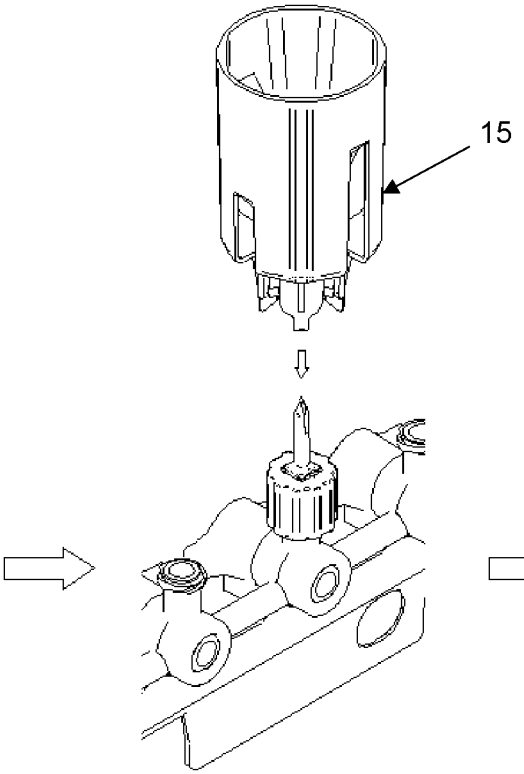
Figure 11D:
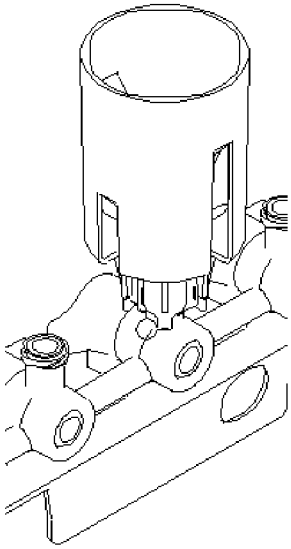

The guiding accessory 15 comprises hooks 16 allowing to attach to the needle via a nut 19. The hooks 16 clip behind the nut 19 gripping the needle as shown in FIG. 10. The presence of these hooks 16 prevents the guiding accessory 15 from detaching from the needle once it is attached thereto. Once the guiding accessory and the perforating needle are assembled on the connecting device, the user needs only insert the vial into the guiding accessory and push it in to pierce the septum.

Two pairs of lower and upper fins 18*a*, 18*b* located at different depths in the guiding accessory 15 keep the flask in place, the first 18*b* in the unpierced position, the second 18*a* in the position pushed in on the needle. These pairs of fins 18*a*, 18*b* are visible in FIG. 9, which shows two sectional views of the guiding accessory shown in FIG. 8.

FIG. 10 shows the operating principle of the pairs of fins 18*a*, 18*b* in the presence of an inverted flask. The left sectional view shows the flask not yet pierced, kept in the high position by the upper pair of fins. The right sectional view shows the flask pushed in and maintained on the needle by the lower pair of fins 18*b*.

In the embodiment shown in FIG. 11, the proximal end 10 of the needle 1 forms a male "Luer" coupling that can adapt on any fluid-transfer device provided with a female "Luer" coupling.

FIG. 11 shows perspective views of the mounting of the perforating needle on a coupling device allowing to introduce a fluid therein. In step (A), the needle 1 comprises a male "Luer" coupling attaching on a fluid-transfer device with a female "Luer" coupling. In step (B), a nut 19 is introduced on the needle. This nut comprises a recess with a shape (essentially rectangular or square) that is complementary to the upper part of the stop 4 of the needle so as to keep it firmly in the vertical position. In step (C), the guiding accessory is positioned on the needle provided with a nut, the hooks 16 of the guiding accessory clipping behind the nut (see FIG. 10). Step (D) shows the finalized assembly, the guiding accessory being ready to accommodate a flask in the inverted position as shown in FIG. 10.

As an alternative to the "Luer" coupling shown in FIG. 11, the proximal end 10 of the needle can comprise another type of connection, fluted or to be welded, for example. The fluid enters or leaves through this connection.

In another embodiment, the needle can be used in a reduced-pressure injection system so as to transfer a fluid from a flask to a syringe or vice versa.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1. Perforating needle
2. Flask
3. Cylindrical body
4. Stop
5. Pointed end
6. Stopper or septum
7. Fluid
8. Orifice
9. Distal end
10. Proximal end
11. Central channel
12. Side wall
13. Central island
14. Separating rim
15. Guiding accessory
16. Hook
17. Slot
18*a*. Lower fin
18*b*. Upper fin
19. Nut

The invention claimed is:

1. A perforating needle intended to be inserted into a flask through a stopper or septum to inject and remove a fluid, the needle comprising:

a pointed end configured to pierce the stopper; and a cylindrical body comprising a central channel through which the fluid may enter and leave the flask and a side wall comprising at least one lateral orifice, the orifice being in fluid communication with the central channel and a lower end of the orifice being, in use, essentially level with an inner face of the stopper, the orifice being extended toward the pointed end by at least one slot, a shape of which is essentially tangential to a flow of the fluid so as to channel the fluid along an axis of the needle, wherein the side wall comprises at least two diametrically opposite lateral orifices arranged on either side of a central island, the central island having a separating rim forming an angle of between 15° and 60°, wherein the separating rim penetrates the central channel, and wherein the slots extending the orifices emerge near the pointed end.

2. The perforating needle according to claim 1, wherein the perforating needle is comprised of rigid plastic material.

3. The perforating needle according to claim 1, wherein the perforating needle is configured to be inserted into a flask comprising a stopper comprised of elastomeric or plastic material.

4. The perforating needle according to claim 1, further comprising a wider zone of the side wall comprising a stop on which a nut can bear so as to firmly attach the needle on a fluid connection device.

5. The perforating needle according to claim 1, further comprising by a guiding accessory configured to be irreversibly attached on the perforating needle to maintain and guide the flask.

6. The perforating needle according to claim 5, wherein the guiding accessory comprises hooks configured to maintain the guiding accessory on the needle, either directly or using a nut.

7. The perforating needle according to claim 5, wherein the guiding accessory comprises pairs of fins that are configured to maintain the flask irreversibly.

8. The perforating needle according to claim 7, wherein a first pair of fins is placed in a high position in order to maintain the flask above the needle before the stopper is pierced, and a second pair of fins is placed in a low position in order to keep the flask pushed in on the needle after the stopper has been pierced.

9. The perforating needle according to claim 1, wherein the angle is between 20° and 30°.

* * * * *